US006178567B1

(12) United States Patent
Bliss

(10) Patent No.: US 6,178,567 B1
(45) Date of Patent: Jan. 30, 2001

(54) MULTI-FLUSH SYSTEM AND METHOD

(76) Inventor: Edward J. Bliss, 437 Sapphire Way, Pittsburgh, PA (US) 15224

( * ) Notice: Under 35 U.S.C. 154(b), the term of this patent shall be extended for 0 days.

(21) Appl. No.: 09/304,182

(22) Filed: May 3, 1999

Related U.S. Application Data

(66) Substitute for application No. 08/606,862 on Feb. 6, 1996, now abandoned.

(51) Int. Cl.[7] ..... E03D 5/00
(52) U.S. Cl. ..... 4/405; 4/324; 4/325; 4/326
(58) Field of Search ..... 4/324, 325, 326, 4/327, 345, 378, 405, 411, 412, 413, 414, 415, 249

(56) References Cited

U.S. PATENT DOCUMENTS

| | | | | |
|---|---|---|---|---|
| 1,767,043 | | 6/1930 | Blaun et al. . | |
| 2,609,546 | * | 9/1952 | Gulick . | |
| 3,768,103 | * | 10/1973 | Robinson | 4/67 |
| 3,795,016 | | 3/1974 | Eastman . | |
| 3,916,455 | | 11/1975 | Longdin . | |
| 4,141,092 | * | 2/1979 | Jones | 4/324 |
| 4,145,774 | * | 3/1979 | Sullivan | 4/325 |
| 4,504,984 | | 3/1985 | Burns . | |
| 4,651,359 | | 3/1987 | Battle . | |
| 4,878,256 | * | 11/1989 | Bagwell | 4/326 |
| 5,117,513 | * | 6/1992 | Burrowes | 4/324 |
| 5,175,893 | * | 1/1993 | Navarrete | 4/326 |

* cited by examiner

*Primary Examiner*—Henry J. Recla
*Assistant Examiner*—Khoa D. Huynh
(74) *Attorney, Agent, or Firm*—Clifford A. Poff

(57) ABSTRACT

The flush system for a toilet provides a discharge pipe upstanding within a flush tank of the toilet. The pipe has a bottom with a bottom opening through which water from the flush tank travels to the toilet bowl of the toilet. The bottom is connected to the first inlet controlled by a first valve and a second inlet controlled by a second valve. The first inlet is at a higher elevation than the second inlet with respect to the bottom opening. The flush system further comprises actuating handle for selectively moving the first and second members in a first mode or a second mode such that in the first mode, only the second inlet is opened and in the second position the first and second inlets are opened.

5 Claims, 6 Drawing Sheets

MULTI-FLUSH SYSTEM AND METHOD

CROSS REFERENCE TO RELATED APPLICATION

This is a substitute application for application Ser. No. 08/606,862, Filed Feb. 6, 1996, now abandoned.

BACKGROUND OF THE INVENTION

1. Field of the Invention

The present invention relates to a water conserving flush system for toilets and, more particularly, to a toilet flush system in which the quantity of water discharged from the flush tank is controllably preselected.

2. Description of the Prior Art

Water conservation has become a critical issue resulting in municipalities imposing temporary water saving measures. Therefore, it is desirable to conserve as much water as possible during our daily activities. Most toilets consume approximately 5 gallons of water during each flush. However, there are many instances when the water consumption can be reduced and remain effective to flush waste from the toilet.

Currently in widespread use are flush systems that either waste water, by using a full tank of water to flush down liquid waste, or are only partially effective because they always use a small quantity of water than the full tank flush toilet. These latter system is suitable for flushing down liquid waste, but the use of the same small quantity of water to flush down solid waste cannot push the solid waste far enough into the sewer line to prevent solid waste clogs from occurring. Another type of flush system uses two flush handles to allow the user to decide between a partial tank flush for liquid waste and a full thank flush for solid waste. Therefore, with the existing systems, the user either cannot select the volume of water used or must choose between two different handles or must activate the handle more than once. It is highly possible that the user will inadvertently waste water or create a clogged sewer line by simply electing the wrong flush. These known flush systems are not efficient because they either waste water or money spent on sewer line service calls.

Therefore, it is desirable to provide a system having two flush modes for a toilet of which one flush mode discharges a first, relatively small, amount of water in the flush tank for flushing liquids or small debris from the toilet and a second flush mode which discharges a maximum discharge amount of water for flushing larger debris from the toilet.

It is an object of the present invention to provide a handle assembly embodying a construction and relationship of parts mounted exteriorly of the flush tank for a toilet to insure longevity of operation unaffected by contact with water stored in the flush tank and contaminates such as mineral deposits derived from stored quantities of water.

SUMMARY OF THE INVENTION

According to the present invention there is provided a flush system for the toilet, the flush system including an elongated discharge pipe having an opening at one end for connection with a flush tank to discharge water to a toilet, the discharge pipe having first and second inlet openings spaced along the length thereof for delivering water from the tank through the bottom opening, each of the first and second inlet openings having a valve member movable between water discharge position and water blocking position, and a flush control handle including an actuator arm joined by flexible lines with the valve member for each of the first and second inlet openings, a mounting stud including a flush control member at one end opposite a fastener for static support by a flush tank, a handle drivingly interconnected with the actuator arm for pivotally support by the mounting stud, the handle having a cavity containing a projecting wall supporting one end of a spring engaging at the opposite end thereof with a moveable piston resiliently positioned by the spring against a stop in the cavity, the flush control member extending into the cavity between the projecting wall and the moveable piston for pivotally controlling the position of the actuator arm in a first position where the valve member for the first inlet opening is moved to the water discharge position while the valve member for the second inlet opening remains in the water blocking position, pivoting of the handle causing compression of the spring between the flush control member and the projecting wall thereby pivotally positioning the actuator arm to a second position wherein the valve member for the second inlet opening is moved to the water discharge position.

The present invention also provides a method for discharging different quantities of water from a water tank for flushing a toilet, the method including the steps of turning a handle and an actuator arm rigidly connected thereto through a first angle into confrontation with a resilient biased abutment such that the actuator arm opens a first valve situated to discharge a minimum quantity of flush water from a flush tank to the toilet, and turning the handle through a second angle greater than the first angle to displace the resiliently biased abutment to a position such that the actuator arm opens the first valve and a second valve situated to discharge a maximum quantity of flush water from the flush tank to flush the toilet.

BRIEF DESCRIPTION OF THE DRAWINGS

These features and advantages as well as others will be more fully understood when the following description is read in light of the accompany drawings in which.

DETAILED DESCRIPTION OF THE PREFERRED EMBODIMENT

Figure 1:
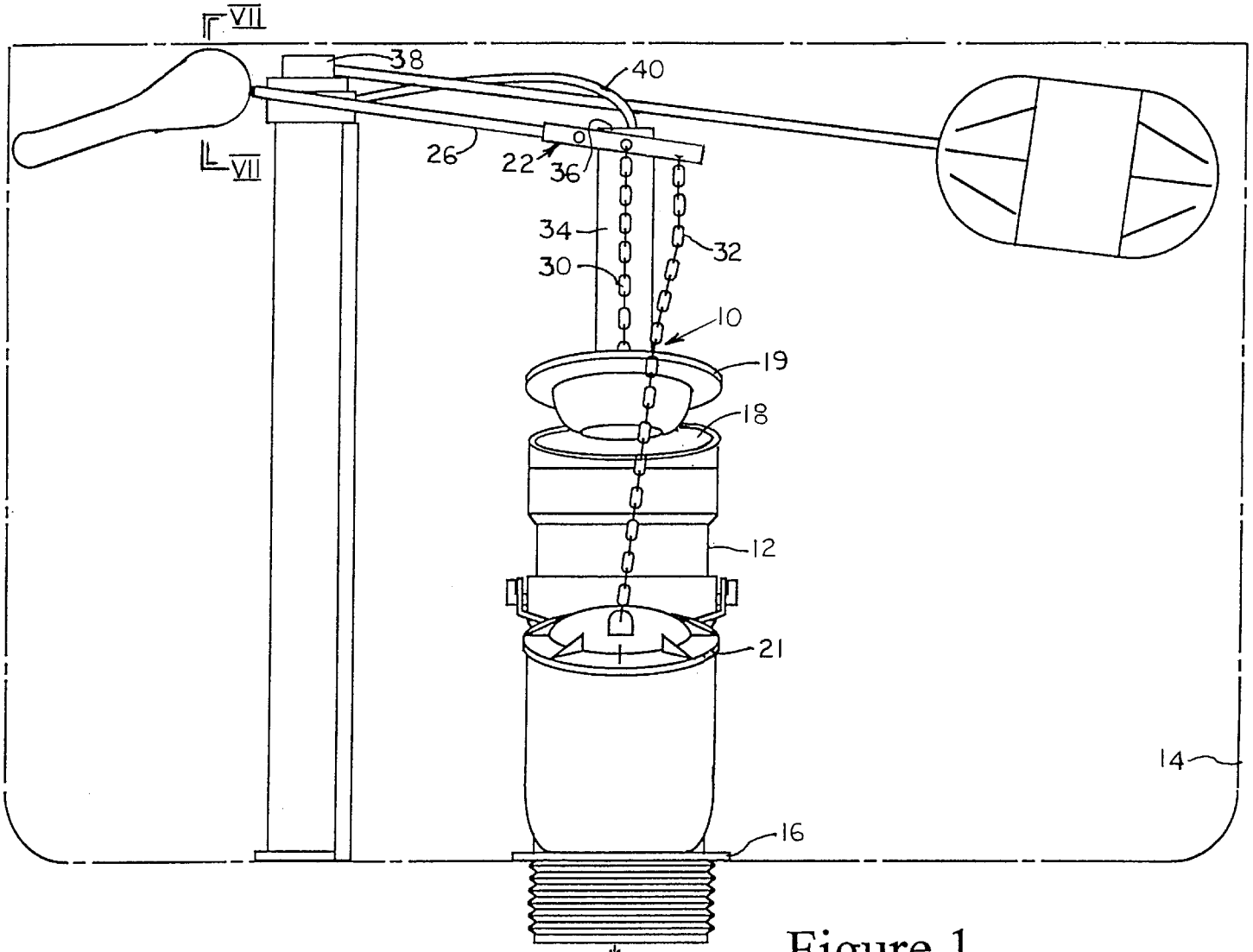
FIG. 1 is a schematic representation showing the flush system with only the first inlet opened.
Figure 2:
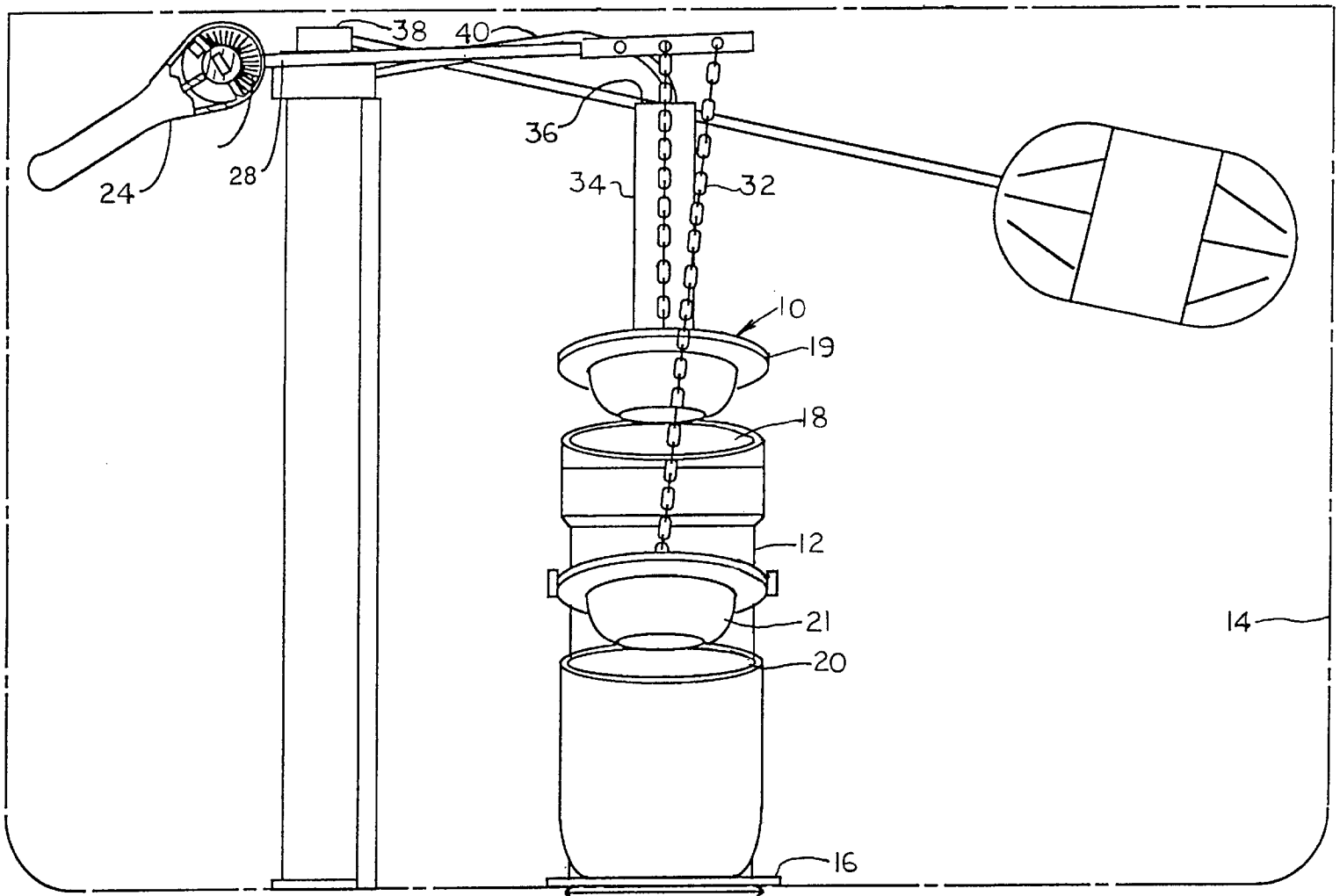
FIG. 2 is a schematic representation showing the flush system with the first and second inlets opened.

There is shown in FIGS. 1 and 2 a flush system 10 including a discharge pipe 12 upstanding within a flush tank 14 of the toilet. The pipe 12 has a flanged discharged end 16 mounted to the flush tank 14 for directing water received in the pipe 12 from the flush tank 14 to the toilet bowl (not shown) of the toilet. At the top portion of the discharge pipe 12 is a first water inlet 18 controlled by a valve 19 having spaced apart support arms pivotally supported by the discharge pipe to allow pivoting of the valve 19 between open and closed positions. The pipe 12 is provided at an elevation beneath the first water inlet 18 as shown in FIGS. 1 and 2 with a second water inlet 20 controlled by a valve 21 having spaced apart support arms pivotally supported by the discharge pipe to allow pivoting of the valve 21 between open and closed positions. Valves 19 and 21 are preferably a Douglas valve, per se well known in the art.

The flush system 10 further includes an actuator 22 for selectively controlling the first and second valves 19 and 21 for two modes of operation. In the first mode only valve 19 is opened for delivering the volume of water in the flush tank 14 above inlet 18 to the toilet while valve 21 remains closed thereby preventing discharge of the volume of water in the tank between inlet 18 and inlet 20 to the toilet. In the second mode, valve 19 will be opened by the first mode and valve 21 is additionally opened so that flush water is discharged from the tank to the elevation of inlet 20 for valve 21. Thus in the second mode, the first and second inlets 18 and 20 are both opened.

In a preferred embodiment of the flush system 10, the actuator 22 includes a handle assembly 24 drivingly interconnected with an actuator arm 26 which is in turn interconnected by first and second flexible lines 30 and 32, such as thin chains, to the valves 19 and 21, respectively. Line 32 has a predetermined length providing a desired amount of slack as compared with a relatively small amount of slack provided by the predetermined length of line 30. Rotation of the handle assembly 24 to a first position, as shown in FIG. 1, causes the first flexible line 30 to pull the valve 19 to open the first inlet 18 while the second inlet 20 remains closed by valve 21. Rotation of the handle assembly 24 to a second position, as shown in FIG. 2, causes the second flexible line 32 to pull the valve 21 to an open position to allow entrance of the water through inlet 20. Extending vertically beyond inlet 18 as closed by valve 19 is a tube 34 which has a water receiving opening 36 at an elevation in the tank for overflow protection in the event the float operated water control valve 38 is improperly adjusted or fails to perform the intended function of shutting off the supply of water to the tank when the water level reaches the water receiving opening 36. The water receiving opening 36 also allows for operation of a refill tube 40 for filling the toilet bowl with water after flushing.

Figure 3:
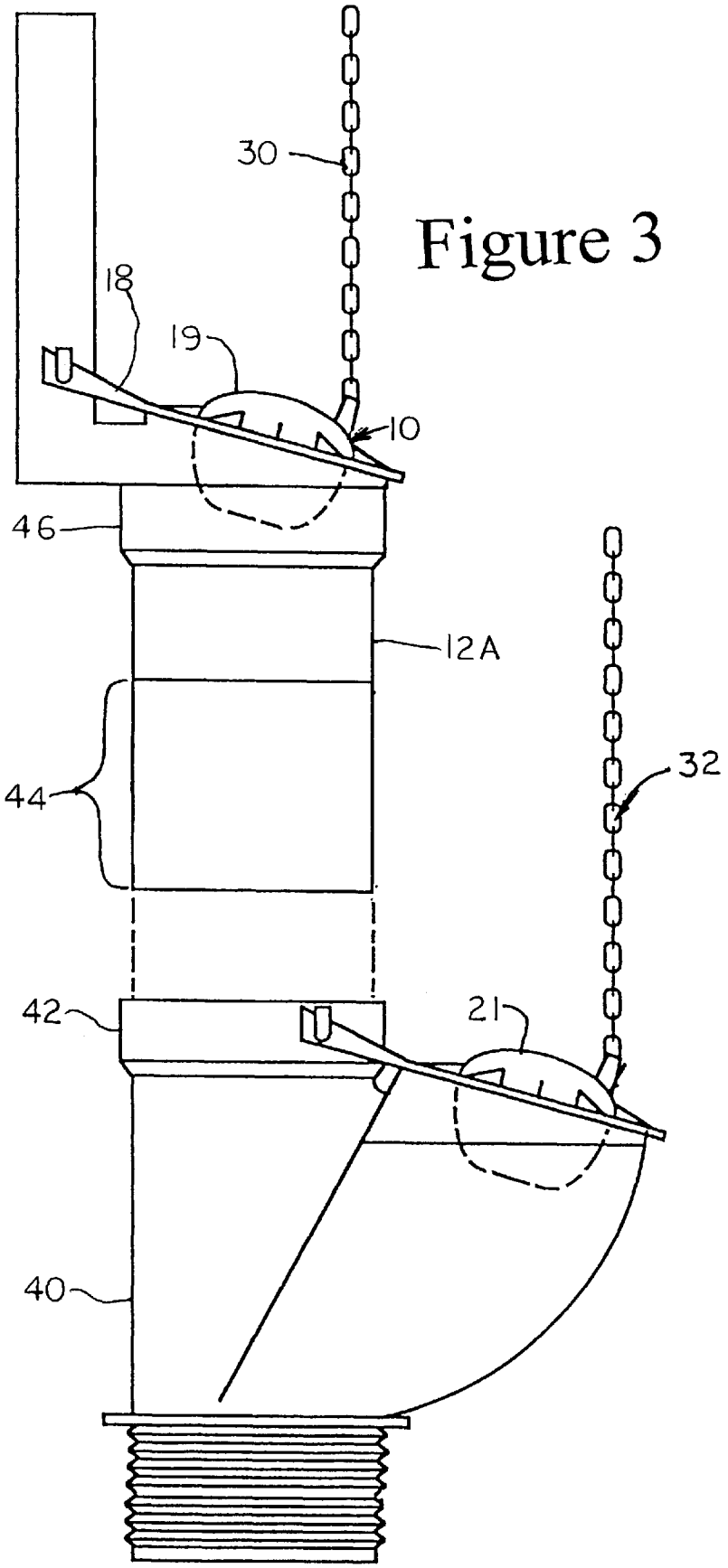
FIG. 3 is a schematic representation showing a side view of a first embodiment of the discharge tube.
Figure 4:
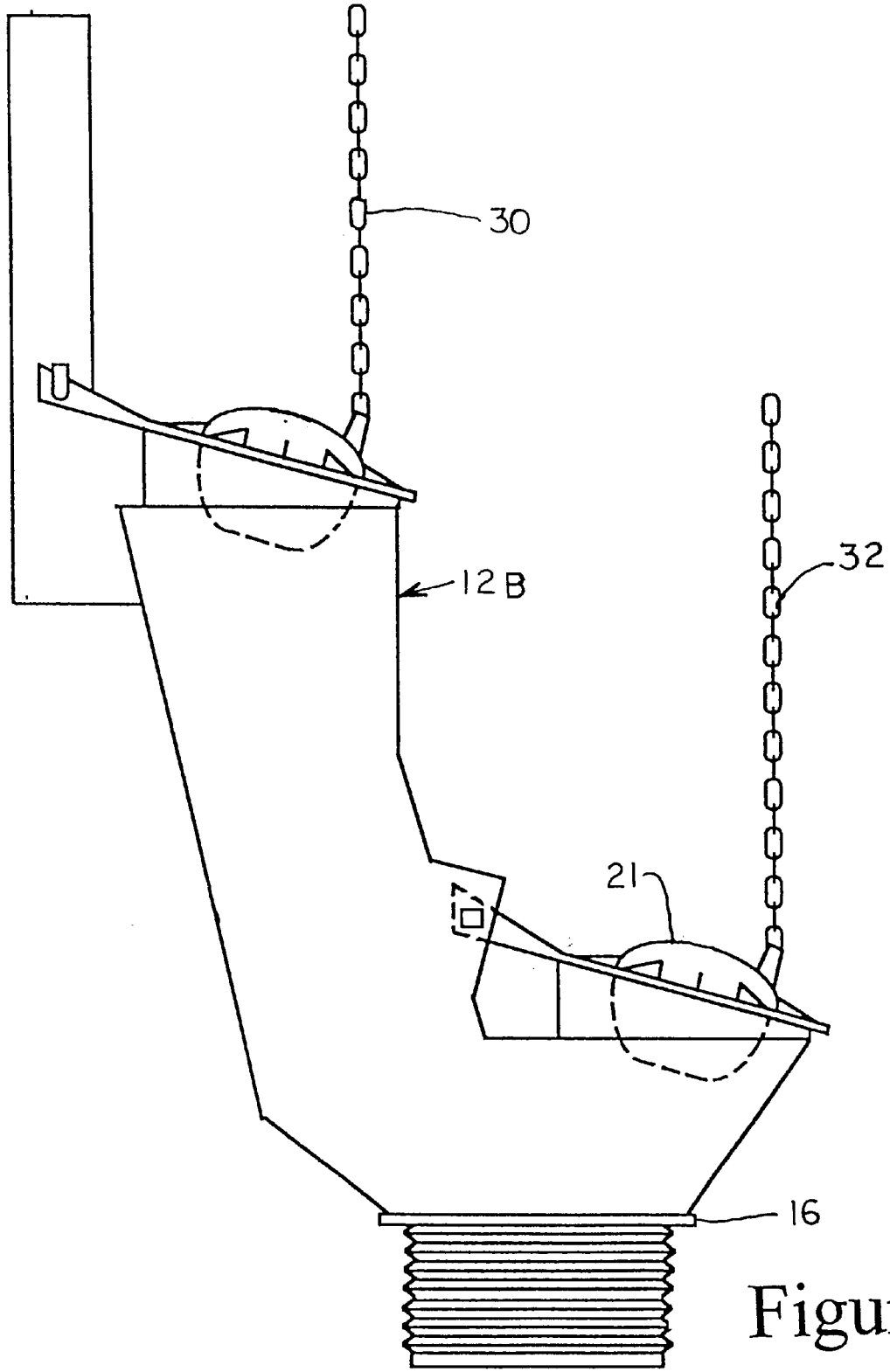
FIG. 4 is a schematic representation showing a side view of a second embodiment of the discharge tube.
Figure 6:
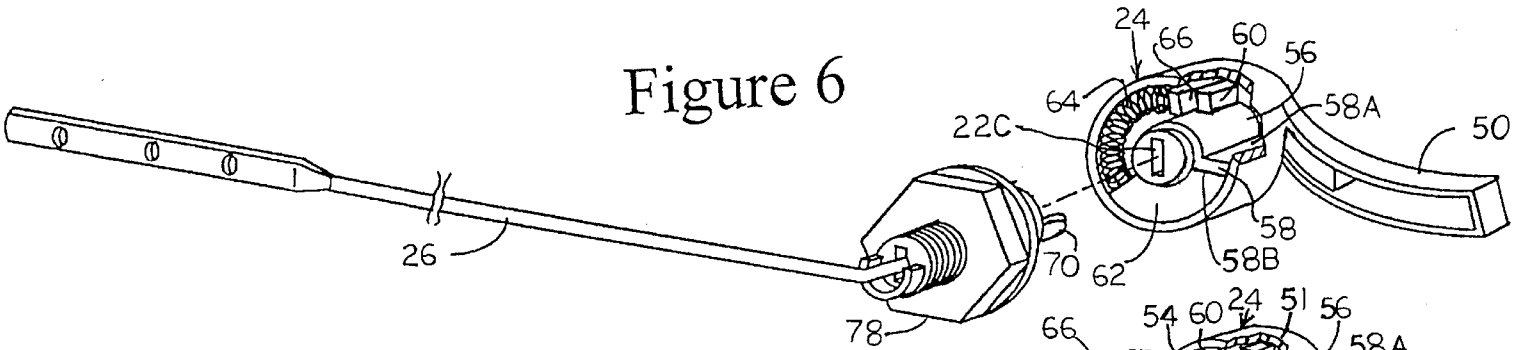
FIG. 6 is a view similar to FIG. 5 in illustrating partial assembly of the parts of the flush control handle.
Figure 5:
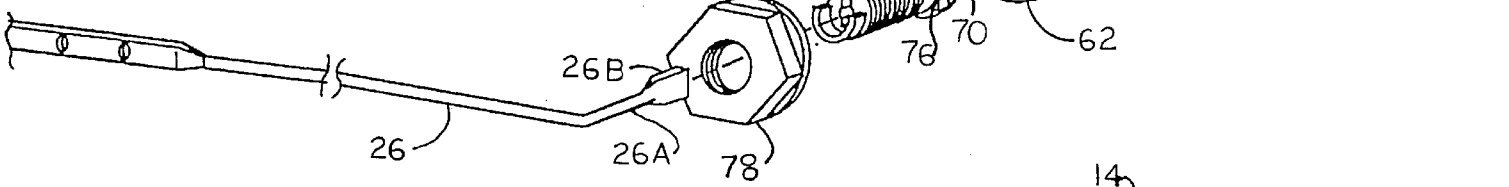
FIG. 5 is an isometric illustration of parts forming a flush control handle according to the present invention.
Figure 7:
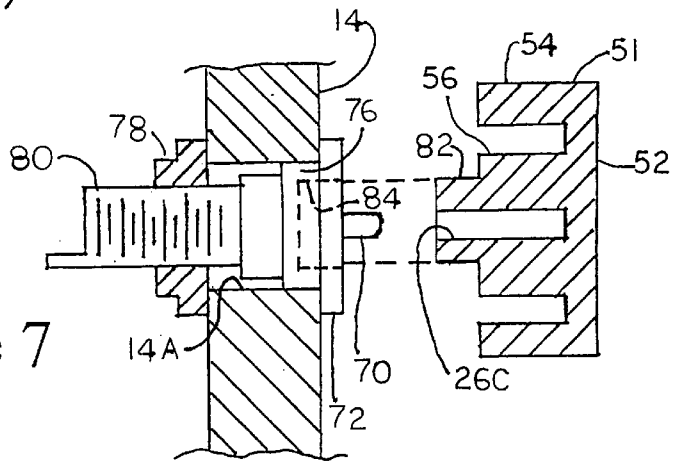
FIG. 7 is a section view taken along lines VII—VII of FIG. 1.

Preferably, as shown in FIG. 3, the discharge pipe 12A is made up of two component parts comprising a first lower component 40 having an enlarged flange 42 into which an elongated cylindrical portion 44 of constant diameter of an upper component 46 is secured in a water-tight fashion. The cylindrical portion 44 of cam slot diameter to allow variations to the length can be adjusted by removing a selected part so that the discharge pipe 12A can be at an established predetermined length specifically adapted to a particular water tank. The flush system is designed for sale in kit form with a plurality of different length tube portions 44 for allowing the flush system 10 to be installed in a variety of different sized water tanks. Further, by altering the length of the tube 44, the amount of water discharged through the opening 18 when valve 19 is moved to an open position, can be selectively chosen by the user in relation to the cross sectional area of the water tank. It is well known that the dimensions of water tanks may vary from tank-to-tank. Preferably, the discharge pipe 12A is comprised of polyvinyl chloride material (PVC). As shown in FIG. 4, the discharge pipe 12B is comprised of one integral assembly.

The actuator 22 which includes handle assembly 24 and actuator arm 26 are constructed according to the present invention as best disclosed in FIGS. 5–8 to control the operation of valves 19 and 21 and thereby select one of two different volumes of water for discharge during a toilet flush. The handle assembly 24 includes a handle body made up of a handle portion 50 extending radially from a cup-shaped body portion 51. Body portion 51 includes an end face wall 52 from which there extends an annular side wall 54 forming a cavity containing a centrally located annular projecting wall 56. An annular gap formed between side wall 54 and the projecting wall 56 is traversed by a radial wall 58 which forms opposed abutment face surfaces 58A and 58B and angularly spaced from wall 58, e.g. 90°, is a foreshortened radial wall 60 forming a stop establishing a demarcation position for the second position of handle assembly 24. A spacer 62 having the form of an annular segment has an end face which abuts against face surface 58B and a locator post 62A engaging in a space formed by end convolutions of a coil spring 64. The end convolutions of the free end of spring 64 engage a locator post 66A extending from one face surface of a movable piston 66 having a face surface 66B opposite the surface containing locator post 66A normally seated against radial wall 60. When the handle assembly 24 is in a ready position for instituting a flush control, an arcuate gap exists between face surface 66B and abut face surface 58A. Extending into this gap is a flush control member 70 having the form of a projection extending outwardly from an annular collar 72 comprising an integral part of a mounting stud 74. At the side of the collar 72 opposite flush control member 70 is a square anchor section 76 dimensioned to extend within a similarly shaped and dimensioned opening 14A (FIG. 7) in the wall of a flush tank 14. A nut 78 is threadedly engaged with threads on a barrel portion 80 of the mounting stud to mount and statically support the mounting stud to the wall of the flush tank. An annular face surface 82 has a reduced diameter and forms a protrusions extending from an annular projecting wall 56. An annular recess 84 opens out of the end face surface of annular collar 72 for rotatably supporting the annular face surface 82 in a press-fitted relation. Actuator arm 26 has a "L" shaped configuration formed by a right-angled end portion 26A having an enlarged torque receiving connector 26B pass through a hollow interior of the body of mounting stud 74 and through a slotted throat 26C extending interiorly of projecting wall 56 establishing a torque transmitting relation between handle portion 50 and actuator arm 26.

Figure 8A:
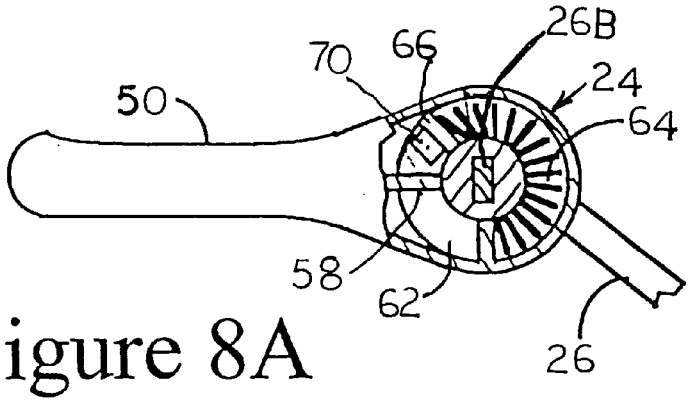
FIGS. 8A–8C are schematic representations showing the flush control handle in a ready position, first flush position and a second flush position, respectively.
Figure 8B:
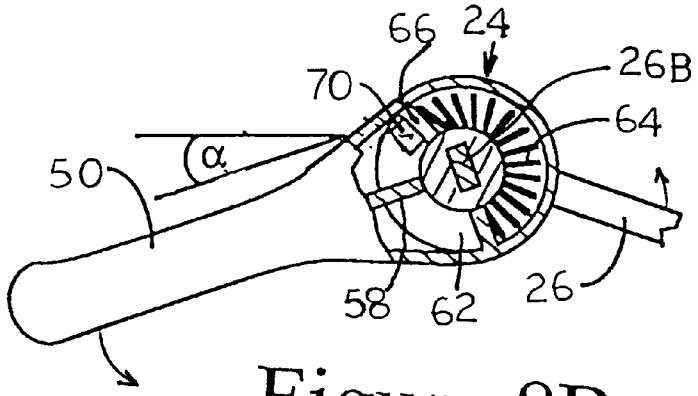
Figure 8C:
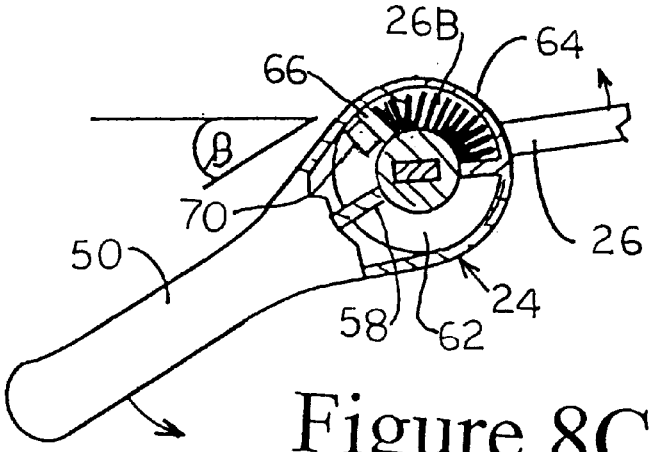

In FIG. 8A the actuator assembly is shown in a stand-by or ready position and as such flush control member 70 rests against face surface 58A. Spring 64 provides a resilient biased force applied by piston 66 for resistance by stop 60 and applied by spacer 62 for resistence by wall 58. To discharge a minimum amount of water from the flush tank, as shown in FIG. 8B, handle 51 is rotated through an angle $\alpha$ which moves the piston 66 into engagement with flush control member 70 without compressing spring 64 whereby the piston remains resiliently positioned against stop 60. The rotation of handle 50 is sufficient to displace the end of actuator rod 26 upwardly and thereby lift valve 19 from inlet 18 allowing the volume of water between overflow 36 and inlet 18 to pass from the water tank into the toilet. To discharge the maximum amount of water from the flush tank, as shown in FIG. 8C, handle 50 is rotated through an angle $\beta$ which includes angle $\alpha$. The piston 66 is engaged with flush control member 70 and compresses spring 64 whereby the piston 66 is displaced away from stop 60. The rotation of handle 50 is sufficient to displace the end of actuator rod 26 upwardly and thereby lifting both of the valves 19 and 21 from their respective inlets 18 and 20 allowing the volume of water between overflow 36 and inlet 20 to pass rom the water tank into the toilet.

While the present invention has been described in accordance with the preferred embodiment, it is to be understood that other similar embodiments may be used or modifications and additions may be made to the described embodiment for performing the same or similar functions of the present invention without deviating therefrom. Therefore, the present invention should not be limited to any single embodiment but rather construed in breadth and scope in accordance with the recitation of the appended claims.

What is claimed is:

1. A flush system for a toilet, said flush system including:

an elongated discharge pipe having an opening at one end for connection with a flush tank to discharge water to the toilet, said discharge pipe having a first inlet opening and a second inlet opening with the second inlet opening at an elevation beneath said first inlet opening for delivering water through a bottom opening in the flush tank, each of said first inlet opening and said second inlet opening having a valve member movable between a water discharge position and a water blocking position; and a flush control handle assembly including an actuator arm joined by flexible lines with said valve member for each of said first inlet opening and said second inlet opening, a mounting stud including a flush control member at one end opposite a fastener for static support by the flush tank, a handle portion drivingly interconnected with said actuator arm for pivotally support by said mounting stud, said handle having a cavity containing a projecting wall supporting one end of a spring engaging at the opposite end thereof with a moveable piston resiliently positioned by said spring against a stop in said cavity, said flush control member extending into said cavity between said projecting wall and said moveable piston for pivotally controlling the position of said actuator arm in a first position wherein said valve member for said first inlet opening is moved to the water discharge position while said valve member for the second inlet opening remains in the water blocking position further pivoting of said handle causing compression of said spring between said flush control member and said projecting wall thereby pivotally positioning said actuator arm to a second position wherein said valve member for said second inlet opening is moved to the water discharge position.

2. The flush system according to claim 1 wherein said cavity of said handle is an annular cavity and said projecting wall traverses said annular cavity.

3. The flush system according to claim 1 wherein said stop is formed by a face surface of the moveable piston located in said cavity.

4. A flush system according to claim 1 wherein said discharge pipe includes first and second elongated pipe sections joined together in a fluid type manner by a joint located between said first and second inlet openings, one of said first and second elongated pipe sections having an elongated portion of constant diameter which can be cut to desired lengths to allow variations to the length thereof and thereby establishing a predetermined height for an upper most one of said first and second inlet openings in the flush tank.

5. A flush system according to claim 1 wherein said discharge pipe has a third inlet opening at an elevation above said first and second inlet openings with respect to said opening at a bottom of said discharge pipe.

* * * * *